US011933045B2

(12) United States Patent
Headley et al.

(10) Patent No.: US 11,933,045 B2
(45) Date of Patent: Mar. 19, 2024

(54) CEILING SYSTEM

(71) Applicant: TURF DESIGN, INC., Gilberts, IL (US)

(72) Inventors: Dustin Headley, Hoffman Estates, IL (US); Jason Gillette, Chicago, IL (US)

(73) Assignee: Turf Design, Inc., Gilberts, IL (US)

( * ) Notice: Subject to any disclaimer, the term of this patent is extended or adjusted under 35 U.S.C. 154(b) by 0 days.

(21) Appl. No.: 18/382,283

(22) Filed: Oct. 20, 2023

(65) Prior Publication Data

US 2024/0044136 A1 Feb. 8, 2024

Related U.S. Application Data

(63) Continuation of application No. 17/534,051, filed on Nov. 23, 2021, now Pat. No. 11,834,827, which is a continuation of application No. 16/566,444, filed on Sep. 10, 2019, now Pat. No. 11,199,004, which is a continuation of application No. 15/639,604, filed on Jun. 30, 2017, now abandoned.

(60) Provisional application No. 62/517,651, filed on Jun. 9, 2017, provisional application No. 62/357,049, filed on Jun. 30, 2016.

(51) Int. Cl.

| | |
|---|---|
| ***E04B 9/04*** | (2006.01) |
| ***E04B 9/00*** | (2006.01) |
| ***E04B 9/36*** | (2006.01) |
| *E04B 9/34* | (2006.01) |

(52) U.S. Cl.

CPC ..... *E04B 9/0407* (2013.01); *E04B 9/001* (2013.01); *E04B 9/366* (2013.01); *E04B 9/0435* (2013.01); *E04B 9/34* (2013.01); *E04B 2103/04* (2013.01)

(58) Field of Classification Search

CPC ..... E04B 9/0407; E04B 9/001; E04B 9/0435; E04B 9/34; E04B 2103/04

See application file for complete search history.

(56) References Cited

U.S. PATENT DOCUMENTS

| | | | |
|---|---|---|---|
| 1,942,662 | A | 1/1934 | Rosenblatt |
| 2,753,440 | A | 7/1956 | Wakefield |
| 3,312,304 | A | 4/1967 | Chen |
| 3,378,974 | A | 4/1968 | Bush |
| 3,473,280 | A | 10/1969 | Stahlhut |
| 3,522,923 | A | 8/1970 | Charpentier |
| 3,578,105 | A | 5/1971 | Griff |

(Continued)

FOREIGN PATENT DOCUMENTS

| | | |
|---|---|---|
| EP | 0606146 | 7/1994 |

OTHER PUBLICATIONS

Pinta Acoustic Inc., pinta acoustic introduces Sonex® Plano Absorbers Customizable to add a distinctive flair with high sound absorption, pp. 1-4, Oct. 27, 2015, Pinta Acoustic Inc., https://www.pinta-acoustic.com/blog/2015/10/27/sonex-plano-absorbers/.

(Continued)

*Primary Examiner* — Paola Agudelo

(74) *Attorney, Agent, or Firm* — Patrick Sheldrake

(57) ABSTRACT

A ceiling system comprising a ceiling tile comprising a backer panel and a plurality of ceiling components assembled to the backer panel. The plurality of ceiling components include tabs that pass through openings in the backer panel and protrude from a top surface of the backer panel and that are configured to be used to mount the ceiling tile to a ceiling hanger system.

20 Claims, 15 Drawing Sheets

(56) References Cited

U.S. PATENT DOCUMENTS

| | | | | | |
|---|---|---|---|---|---|
| 3,765,141 | A | | 10/1973 | Shayman | |
| 3,774,024 | A | * | 11/1973 | Deaton | F21V 11/06 52/645 |
| 3,969,870 | A | | 7/1976 | Deaton | |
| 3,996,458 | A | | 12/1976 | Jones et al. | |
| 4,197,923 | A | | 4/1980 | Harris | |
| 4,200,171 | A | | 4/1980 | Seymour et al. | |
| 4,228,867 | A | | 10/1980 | Wirt | |
| 4,268,897 | A | * | 5/1981 | Schierwagen | F21V 11/06 362/342 |
| 4,365,449 | A | * | 12/1982 | Liautaud | F21S 2/00 52/777 |
| 4,545,165 | A | * | 10/1985 | Carey | E04B 9/345 52/506.07 |
| 4,665,674 | A | | 5/1987 | Brugman | |
| 5,128,850 | A | | 7/1992 | Juodvalkis | |
| 5,292,282 | A | | 3/1994 | Callas | |
| 5,832,685 | A | | 11/1998 | Hermanson | |
| 6,209,680 | B1 | | 4/2001 | Perdue | |
| 6,374,564 | B1 | | 4/2002 | Fletterick | |
| D658,786 | S | | 5/2012 | Koennecke | |
| 8,733,053 | B2 | | 5/2014 | Kabatsi et al. | |
| 8,782,987 | B2 | | 7/2014 | Kabatsi et al. | |
| 9,038,344 | B2 | | 5/2015 | Mayer | |
| 9,163,402 | B2 | | 10/2015 | Kabatsi et al. | |
| 9,175,473 | B2 | | 11/2015 | Kaump | |
| RE45,851 | E | | 1/2016 | Bodine | |
| 9,279,253 | B1 | | 3/2016 | Gaydos | |
| 9,353,521 | B2 | | 5/2016 | Waters | |
| 9,410,317 | B1 | | 8/2016 | Kilian et al. | |
| D767,171 | S | | 9/2016 | Kilian et al. | |
| D767,816 | S | | 9/2016 | Kilian et al. | |
| D771,279 | S | | 11/2016 | Kilian et al. | |
| D771,280 | S | | 11/2016 | Kilian et al. | |
| D771,281 | S | | 11/2016 | Kilian et al. | |
| 9,506,249 | B2 | | 11/2016 | Kabatsi et al. | |
| D777,349 | S | | 1/2017 | Kilian et al. | |
| D777,943 | S | | 1/2017 | Kilian et al. | |
| D777,944 | S | | 1/2017 | Kilian et al. | |
| D777,945 | S | | 1/2017 | Kilian et al. | |
| D777,946 | S | | 1/2017 | Kilian et al. | |
| D777,951 | S | | 1/2017 | Kilian et al. | |
| D781,464 | S | | 3/2017 | Kilian et al. | |
| D783,182 | S | | 4/2017 | Kilian et al. | |
| D783,183 | S | | 4/2017 | Kilian et al. | |
| D783,184 | S | | 4/2017 | Kilian et al. | |
| D784,562 | S | | 4/2017 | Kilian et al. | |
| D784,563 | S | | 4/2017 | Kilian et al. | |
| D784,564 | S | | 4/2017 | Kilian et al. | |
| D784,565 | S | | 4/2017 | Kilian et al. | |
| D785,212 | S | | 4/2017 | Kilian et al. | |
| 9,663,949 | B1 | | 5/2017 | Caste | |
| D791,979 | S | | 7/2017 | Kilian et al. | |
| D791,980 | S | | 7/2017 | Kilian et al. | |
| D791,981 | S | | 7/2017 | Kilian et al. | |
| D792,986 | S | | 7/2017 | Kilian et al. | |
| D794,222 | S | | 8/2017 | Kilian et al. | |
| D794,223 | S | | 8/2017 | Kilian et al. | |
| D794,224 | S | | 8/2017 | Kilian et al. | |
| D794,836 | S | | 8/2017 | Kilian et al. | |
| D795,466 | S | | 8/2017 | Kilian et al. | |
| 9,739,057 | B2 | | 8/2017 | Bergman | |
| 9,765,519 | B2 | | 9/2017 | Bergman | |
| D802,173 | S | | 11/2017 | Kilian et al. | |
| D802,174 | S | | 11/2017 | Kilian et al. | |
| D821,613 | S | | 6/2018 | Kilian et al. | |
| 10,094,108 | B2 | | 10/2018 | Murao | |
| D840,551 | S | | 2/2019 | Kilian et al. | |
| D846,160 | S | | 4/2019 | Kilian et al. | |
| 2003/0019179 | A1 | | 1/2003 | Colson | |
| 2003/0205016 | A1 | | 11/2003 | Gulbrandsen | |
| 2006/0248826 | A1 | | 11/2006 | Owens | |
| 2011/0078970 | A1 | | 4/2011 | Boyd | |
| 2012/0018247 | A1 | | 1/2012 | Gideonse | |
| 2012/0317915 | A1 | * | 12/2012 | Koennecke | E04B 9/366 52/506.09 |
| 2015/0068135 | A1 | * | 3/2015 | Waters | E04B 9/366 52/39 |
| 2016/0281353 | A1 | | 9/2016 | Gillette | |
| 2017/0073968 | A1 | | 3/2017 | Kilian | |
| 2018/0245344 | A1 | | 8/2018 | Venjen-Jensen | |
| 2018/0336875 | A1 | * | 11/2018 | Patterson | F21V 15/01 |
| 2018/0363295 | A1 | | 12/2018 | Gillette | |

OTHER PUBLICATIONS

Echojazz AG, EchoBaffle, single Facebook® post, single album, and two images from album, Jun. 26, 2015, Facebook®, https://www.facebook.com/echojazz.acoustic/.

Echojazz AG, EchoPanel® Fold-It Maxi by Gavin Harris, single Facebook® post, single album, and three images from album, Jun. 26, 2015, Facebook®, https://www.facebook.com/echojazz.acoustic/.

(Author Uknown), Marketing Bulletin Tectum Sound Baffle Application, Mar. 2006, pp. 1-2, https://www.buildsite.com/pdf/tectum/Hanging-Baffles-Installation-Instructions-B4616.pdf.

* cited by examiner

VIEW A-A PRIOR ART

| FREQUENCY (Hz) | SOUND ABSORPTION COEFFICIENT |
|---|---|
| 32 | .03 |
| 40 | .01 |
| 50 | -.02 |
| 63 | -.07 |
| 80 | .06 |
| 100 | .09 |
| 125 | .12 |
| 160 | .20 |
| 200 | .24 |
| 250 | .33 |
| 315 | .45 |
| 400 | .59 |
| 500 | .76 |
| 630 | .85 |
| 800 | .89 |
| 1,000 | 1.00 |
| 1,250 | 1.06 |
| 1,600 | 1.06 |
| 2,000 | .99 |
| 2,500 | .89 |
| 3,150 | .83 |
| 4,000 | .94 |
| 5,000 | 1.04 |
| 6,300 | 1.00 |
| 8,000 | 1.05 |
| 10,000 | 1.07 |
| 12,500 | 1.07 |

66

68

TEST ARRANGEMENT

PET Acoustic panel + 100mm air layer (Filled with 50mm rock wool board)

CEILING SYSTEM

CROSS-REFERENCE TO RELATED APPLICATION

The present application is a continuation of U.S. Nonprovisional patent application Ser. No. 17/534,051, filed Nov. 23, 2021, which in turn is a continuation of U.S. Nonprovisional patent application Ser. No. 16/566,444, filed Sep. 10, 2019, now U.S. Pat. No. 11,199,004, which in turn is a continuation of U.S. Nonprovisional patent application Ser. No. 15/639,604, filed Jun. 30, 2017, now abandoned, which in turn claims priority to U.S. Provisional Patent Application Ser. No. 62/357,049, filed Jun. 30, 2016, and U.S. Provisional Patent Application Ser. No. 62/517,651, filed Jun. 9, 2017, the entireties of which are hereby incorporated by reference herein as though fully set forth herein.

FIELD OF THE INVENTION

The instant disclosure relates to a drop ceiling product, a system for dynamic acoustic drop ceiling product, along with the methods for installing the drop ceiling product. In particular, the instant disclosure relates to a dynamic acoustic drop ceiling systems that include multiple differently shaped product, components or slats, configured to be quickly and easily installed into a backer panel to create a tile. The tile is then inserted or installed onto drop ceiling hangers or a t-grid to provide an aesthetically pleasing image, such as an undulating image, along with a reduction in unwanted noise and/or room acoustics.

The instant disclosure further relates to an apparatus that is configured using recycled polyester felt or PET Felt, and in an embodiment, provides for numerous differently shaped components that when installed in a repeating pattern, as detailed below, create an undulating effect or image. Each drop ceiling product is configured from a piece of PET Felt and contains one or more installation slots, that allow for the drop ceiling product to be installed first into a backer panel and then into the drop ceiling hanger without any extra tools, clips or additional hardware.

BACKGROUND OF THE INVENTION

In general terms, drop ceilings are suspended below the actual ceiling to restrict the view of the ceiling and create a more appealing view from the floor. Suspended drop ceilings are usually hung at a distance below the structural members to hide mechanical and electrical equipment, along with electrical conduit, HVAC ducts, water pipes, sewage lines, lighting fixtures, and similar structures. In order to construct a suspended drop ceiling, a metal grid is suspended from the actual drop ceiling, usually by wires, and acoustical or similar tiles, are inserted and supported by the grid.

In order to minimize excessive and/or unwanted sound generated because of the exposed ceiling, one solution is to hang product from the ceiling at certain intervals to allow for the exposed ceiling to be viewed, but to reduce the acoustic profile. As an example of a structure intended to reduce unwanted noise is the Supported Architectural Structure disclosed and claimed in U.S. Pat. No. 8,782,987, to Kabatsi et al., which discloses a plurality of primary supports configured to couple with one or more architectural structures, and a plurality of flexible fins is incorporated into the structure using primary supports, secondary supports and attachment points.

Another example of a drop ceiling structure is U.S. patent application Ser. No. 10/774,233, to Stackenwalt et al., which discloses a decorative structure, which may be curved, suspended within a space and which includes a panel fastened to a support structure by a clip, a portion of which extends along a face of the panel.

These examples utilize additional supports, attachment hardware and clips to assist in suspending the flexible fins or decorative panels to the drop ceiling or to drop ceiling structure. In doing so, each of these examples necessitate tools to assemble the structure and to suspend the structure to the drop ceiling or drop ceiling support structure.

As such there is a need for a dynamic acoustic drop ceiling system that includes multiple shaped ceiling product that can be quickly and easily installed onto existing construction drop ceiling hangers or similar support structures without the need for tools, separate attachment devices, clips or the like. There is also a need for a dynamic acoustic drop ceiling system that is an aesthetically pleasing image, such as an undulating image, along with the function of reducing unwanted noise.

The foregoing is intended only to illustrate the present technical field and background art and should not be taken as a limitation or disavowal of claim scope.

BRIEF SUMMARY

The present disclosure is an improved acoustic drop ceiling product, and an improved dynamic acoustic drop ceiling system, along with improved methods for installing the drop ceiling product and creating the dynamic acoustic drop ceiling system. The improvement comprises drop ceiling components that are configured with installation slots to be quickly and easily installed into backer panels to create different tiles. These tiles are then installed into or on drop ceiling hangers or drop ceiling structures, to provide an aesthetically pleasing image, such as an undulating image, along with functioning to reduce unwanted noise or room acoustics. Additionally, the drop ceiling components can be installed directly into the drop ceiling hangers without the backer panels to hold the components in place.

The present disclosure comprises a drop ceiling product that is manufactured from a recyclable and/or recycled material, such as recycled polyester felt or PET Felt, and in an embodiment, provides that each drop ceiling product is configured from a piece of the PET Felt for strength. In this embodiment, the drop ceiling product is generally a rectangular shape with a straight edge top and straight edge sides. Each drop ceiling product comprises an installation slot and the bottom edge of each drop ceiling product is usually different from the others depending on the design. In general, the drop ceiling product repeats at some point in the design. By repeating the shape, less ceiling product designs are needed for particular designs, as detailed below. This drop ceiling product configuration (with the installation slots) allows for the drop ceiling product to be installed into a backer panel and then into the drop ceiling hanger or t-grid without the need for tools, clips or any additional attachment devices. The configuration of the backer panel, once installed, may block the view of the drop ceiling hanger or t-grid from the floor below the ceiling, thereby increasing the aesthetically pleasing image of the drop ceiling system.

The present disclosure further relates to an improved dynamic acoustic drop ceiling system comprising a number of differently shaped drop ceiling product that can be installed into a drop ceiling structure such that the system, as a whole, provides an aesthetically pleasing image, such as an undulating image, based on the placement of the differently shaped drop ceiling product. As a non-limiting example, sixteen drop ceiling product designs can make up a single tile (either with the backer panel or without) that can be replicated at different locations in a room ceiling. By strategically placing the tiles (each made up of sixteen drop ceiling product) in multiple different locations, the ceiling design can be modified. Further, depending on the drop ceiling product for a particular tile, there may only be eight designs necessary, as reversing the ceiling product may provide the desired effect, to create an undulating image.

The present disclosure also relates to an improved method of installing the drop ceiling product and/or backer panel loaded with the drop ceiling product. This method allows for the creation of a dynamic acoustic drop ceiling system, in which the acoustic drop ceiling product are installed into the drop ceiling structure by placing the installation slots of each drop ceiling product into the backer panel and then onto the existing drop ceiling hanger, without the need for additional tools, clips or additional attachment devices, to provide an aesthetically pleasing image, and to function to reduce unwanted noise or room acoustics.

It is thus an objective of the present disclosure to provide an improved acoustic drop ceiling product, comprising installation slots, which allow for the drop ceiling product to be installed into a backer panel and then into an existing drop ceiling hanger without the need for tools, clips or additional attachment devices.

It is yet another object of the present disclosure to provide an improved dynamic acoustic drop ceiling system in which the improved drop ceiling product are installed in a manner and pattern that creates an aesthetically pleasing image and functions to reduce unwanted noise or room acoustics.

It is yet another objective of the present disclosure to provide an improved method for installing the improved drop ceiling product and thereby creating the dynamic acoustic drop ceiling system with an aesthetically pleasing image and which functions to reduce unwanted noise or room acoustics.

In a further aspect, the invention can be a ceiling system comprising: a backer panel comprising: a top surface; a bottom surface opposite the top surface; and a plurality of openings extending from the top surface to the bottom surface; a plurality of ceiling components, each of the plurality of ceiling components comprising: a main body; and a pair of tabs protruding upward from the main body and configured to engage first and second ceiling hangers of a ceiling hanger system; and the plurality of ceiling components assembled to the backer panel to form a ceiling tile in which: (1) the main bodies of the plurality of ceiling components are below the backer panel; and (2) the pairs of tabs of the plurality of ceiling components pass through the plurality of openings and protrude from the top surface of the backer panel to allow mounting of the ceiling tile to the ceiling hanger system via the pairs of tabs engaging the first and second ceiling hangers.

In an even further aspect, the invention can be a ceiling system comprising: a ceiling hanger system comprising a plurality of ceiling hangers arranged in a rectilinear grid defining a plurality of grid openings; a plurality of ceiling tiles, each of the plurality of ceiling tiles comprising: a backer panel formed of an acoustic absorbing material and comprising a top surface, a bottom surface opposite the top surface, and a plurality of openings extending from the top surface to the bottom surface; a plurality of ceiling components formed of an acoustic absorbing material and assembled to backer panel, each of the plurality of ceiling components comprising a main body below the bottom surface of the backer panel and at least one tab extending upward from the main body that passes through one of the plurality of openings of the backer panel and protrudes from the top surface of the backer panel; and the plurality of ceiling tiles mounted to the ceiling hanger system via the tabs of the plurality of ceiling tiles engaging the plurality of ceiling hangers.

In another aspect, the invention can be a ceiling system comprising: a backer panel formed of a felt material and comprising: a top surface; a bottom surface opposite the top surface; and a plurality of openings extending from the top surface to the bottom surface; and a plurality of linear ceiling components formed of a felt material, the plurality of linear ceiling components mounted to the backer panel adjacent the bottom surface of the backer panel in a parallel arrangement to form a ceiling tile, each of the plurality of ceiling components comprising a plurality of tabs that extend through the openings of the backer panel and protrude from top surface of the backer panel, each of the tabs comprising an outwardly-facing recess that is configured to receive and engage an edge of a ceiling hanger of a ceiling hanger system to mount the ceiling tile to the ceiling hanger system.

Additional objectives and advantages of the present disclosure will become apparent to one having ordinary skill in the art after reading the specification in light of the drawing figures, however, the spirit and scope of the present invention should not be limited to the description of the embodiments contained herein.

DETAILED DESCRIPTION

As stated herein, the objective of the present disclosure is to provide an improved acoustic drop ceiling product, and an improved dynamic acoustic drop ceiling system, along with improved methods for installing the drop ceiling product on or into a drop ceiling hanger system or t-grid to create the dynamic acoustic drop ceiling system.

Figure 1:
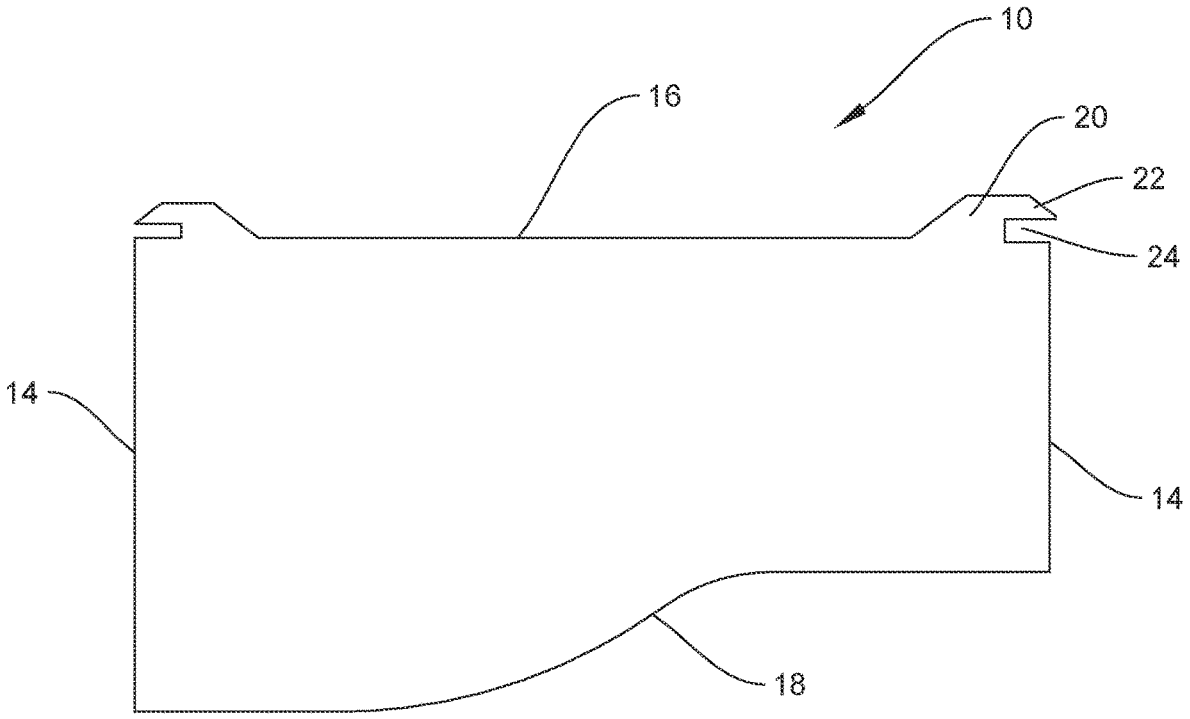
FIG. 1 is a perspective view of an acoustic drop ceiling product in accordance with the present disclosure.

Referring to the drawings, wherein like reference numerals refer to the same or similar features in the various views, FIGS. 1 and 3 through 8 show different views of the improved drop ceiling product 10, tile sections 12 and system 100, which in the preferred embodiment shown in FIG. 1 is a single piece of polyester felt or PET Felt. Each tile section 12 replaces about 24 inches by 24 inches of ceiling space, and each drop ceiling product 10 is about 1 foot, 11⅞ inches long, with varying heights throughout the length to provide the undulating image.

The drop ceiling product generally has two straight sides 14 and a straight top side 16. The bottom side 18, which is seen from the floor when the drop ceiling product 10 or tile section 12 is installed in the ceiling, is either straight or has a curve. When multiple different shaped drop ceiling products 10 are installed in a backer panel (or installed directly onto the ceiling hangers) to create a tile section 12, an undulating image is formed when viewed from the floor.

The drop ceiling product 10 is made from 9 mm thick PET Felt and comprises one or more installation slots 20, usually two, on the drop ceiling product 10 for installation purposes. Each installation slot 20 has a tapered edge 22 and a recess 24 such that when the drop ceiling product 10 is pushed up into the backer panel 26, the tapered edge 22 will deform and/or move around the backer panel 26 (or the t-grid) and then return to the original shape locked into the backer panel 26.

Figure 2:
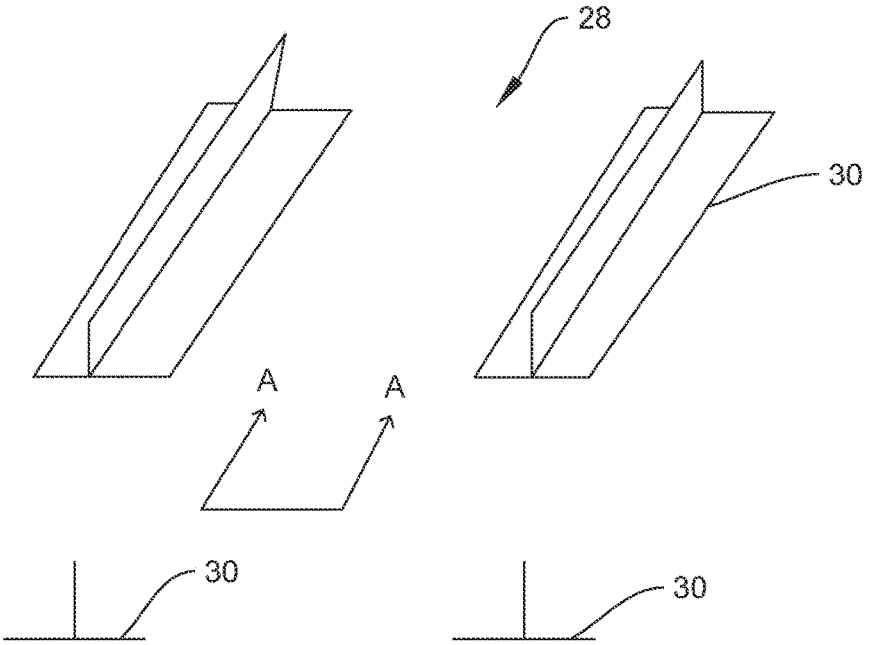
FIG. 2 is a perspective view and the associated cut away view of a prior art standard drop ceiling hanger in accordance with the present disclosure.

FIG. 2 shows a perspective and side view (A-A) of a standard drop ceiling hanger system 28. The standard drop ceiling hanger 30 is normally configured and sized to hold an acoustic tile (not shown), approximately 2 feet by 2 feet, although different size tiles are available, by laying the tile onto the edges of the hanger 30 in a cantilever arrangement. In doing so, the installed tile blocks the view of the actual ceiling, and in some cases, sprinkler systems and vents (not shown) have to be extended to be accessible to the area below the tile.

Figure 3A:
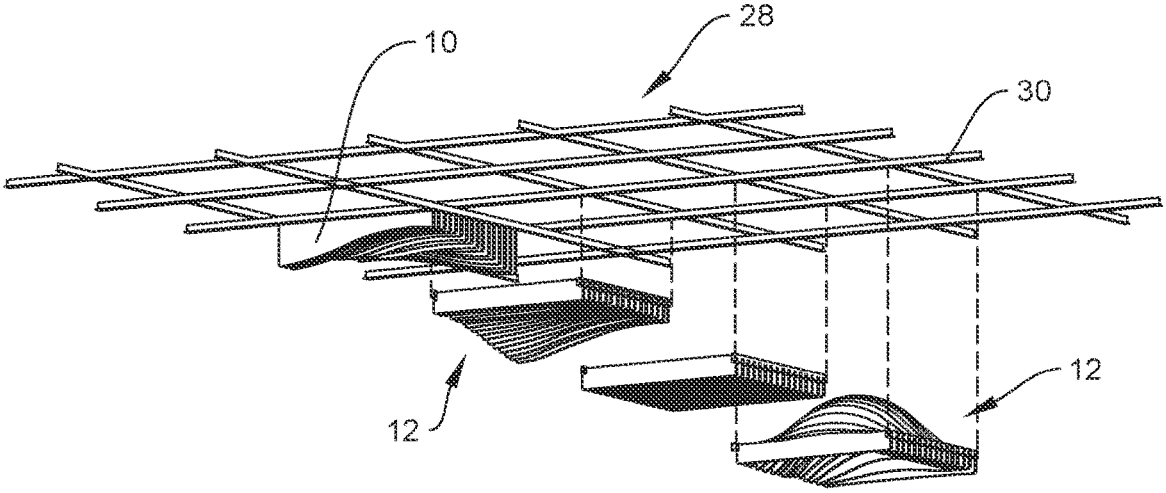
FIGS. 3A through 3C are perspective views of a prior art standard drop ceiling hanger system with installations of four different tiles (FIGS. 3A and 3B) and 16 tiles (FIG. 3C) in accordance with the present disclosure.

FIG. 3A shows a perspective views of four tiles 12 A, B, C and D being installed into a prior art standard drop ceiling hanger system 28 comprising drop ceiling hangers 30. Each drop ceiling product 10 is combined with other drop ceiling product 10 of the same or different shape to generate a tile section 12 and then a drop ceiling system 100 (FIG. 3C). The drop ceiling product 10 can be installed individually onto the t-grid, or installed onto a backer panel 26 for easier installation onto the drop ceiling hanger system 28.

Figure 3B:
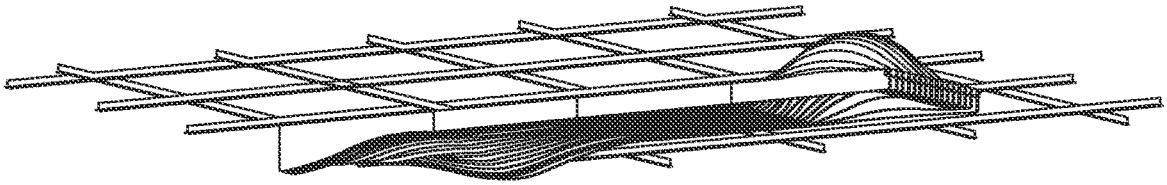
Figure 3C:
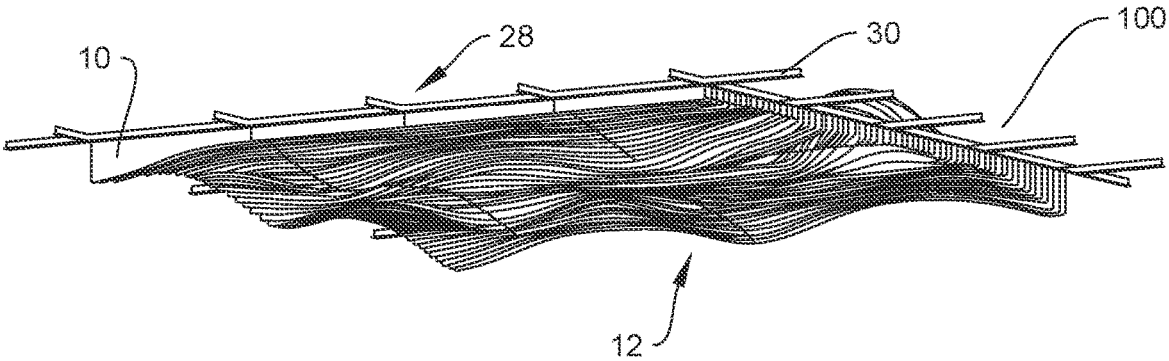
Figure 4A:
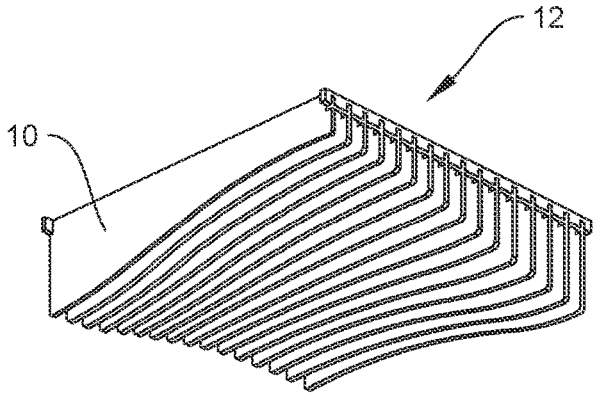
FIGS. 4A through 4D are perspective view (FIG. 4A), plan view (FIG. 4B), side elevation view (FIG. 4C), and front elevation view (FIG. 4D), of a drop ceiling system (Tile A) installed in a prior art standard drop ceiling hanger in accordance with the present disclosure.
Figure 4B:
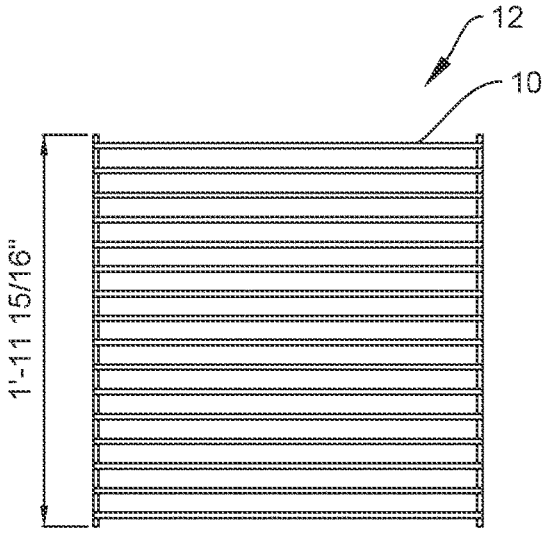
Figure 4C:
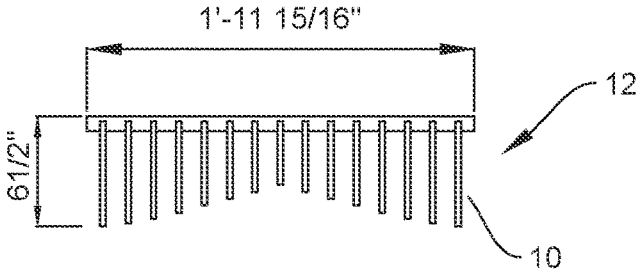
Figure 4D:
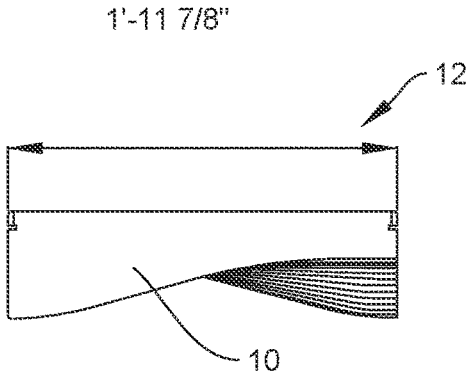

FIG. 3B shows the ceiling system 100 partially assembled after installation of tile sections 12 A, B, C and D. Each of the tiles, A through D, are made up of 16 separate acoustic drop ceiling products 10, as an example. The 16 drop ceiling products 10 may each be a different size and shape, or some or all of the products 10 may be the same size and shape, thereby creating different designs. For example, tile A 12 may comprise 16 drop ceiling products 10 of which there are eight sets of two similar size products arranged from maximum depth to minimum depth and back again.

Tile C 12, on the other hand may have 16 identical drop ceiling products 10, and by combining the different tiles 12, which are made up of the different drop ceiling products 10, an undulating design can be created, and based on the spacing between each drop ceiling product 10, sprinkler systems and vents may not have to be extended.

FIG. 3C shows the drop ceiling system 100 made up of multiple tile sections 12, which are made up of multiple drop ceiling products 10. Each of the drop ceiling product 10 has been installed (directly or with a backer panel 26) onto the drop ceiling hanger system 28 by using the drop ceiling hangers 30.

FIGS. 4 through 7 show exemplary tiles 12 A, B, C and D. These tiles 12 are merely examples of the different drop ceiling products 10 that can be used to create the individual tiles 12. For example, FIGS. 4A through 4D include a perspective view (FIG. 4A), plan view (FIG. 4B), side elevation view (FIG. 4C), and front elevation view (FIG. 4D), of the dynamic acoustic drop ceiling tile section A 12, as previously shown in FIG. 3A. Tile A 12 is installed in a prior art standard drop ceiling hanger 30, in accordance with the present disclosure.

Figure 5A:
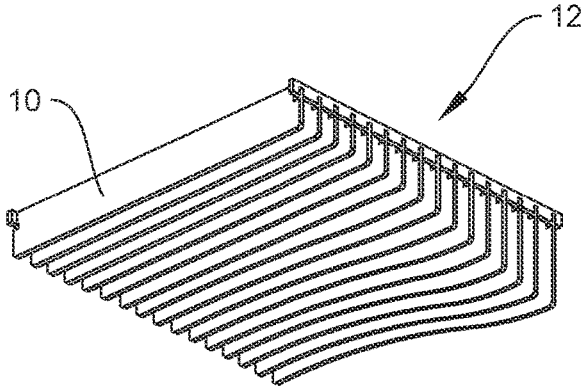
FIGS. 5A through 5D are perspective view (FIG. 5A), plan view (FIG. 5B), side elevation view (FIG. 5C), and front elevation view (FIG. 5D), of a drop ceiling system (Tile B) installed in a prior art standard drop ceiling hanger in accordance with the present disclosure.
Figure 5B:
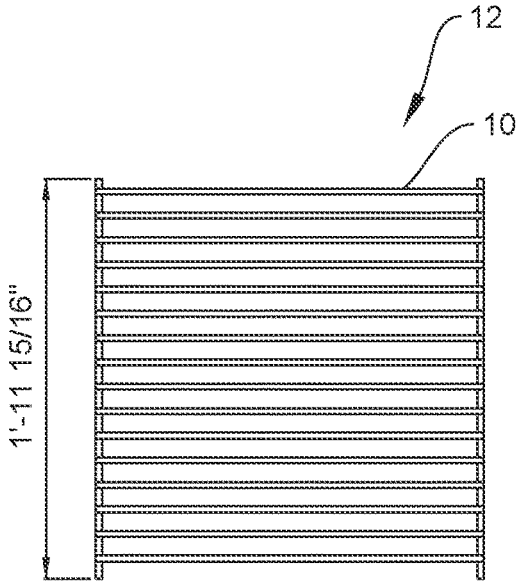
Figure 5C:
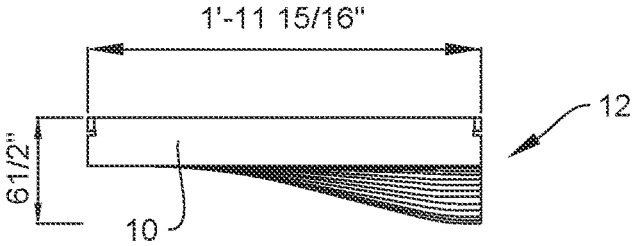
Figure 5D:
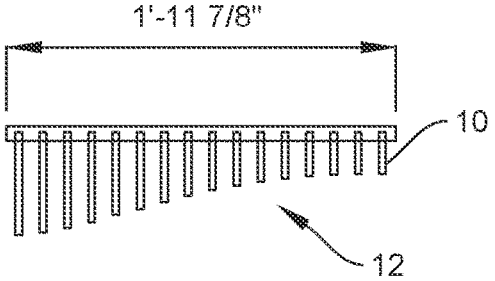

Installed next to tile A 12 is tile B 12, also shown in FIGS. 5A through 5D, which include a perspective view (FIG. 5A), plan view (FIG. 5B), side elevation view (FIG. 5C), and front elevation view (FIG. 5D). The dynamic acoustic drop ceiling tile section B 12, as previously shown in FIG. 3A, is assembled and located next to tile A 12 in the prior art standard drop ceiling hanger 30, in accordance with the present disclosure.

Figure 6A:
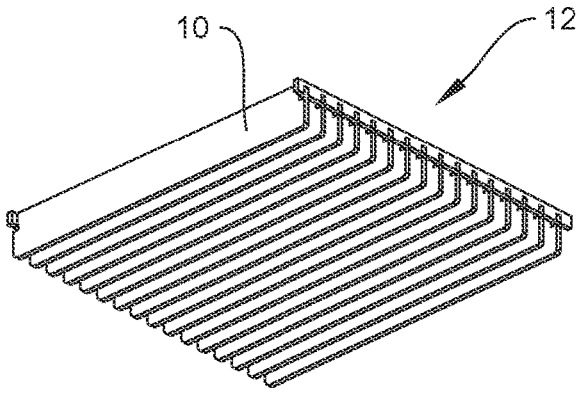
FIGS. 6A through 6D are perspective view (FIG. 6A), plan view (FIG. 6B), side elevation view (FIG. 6C), and front elevation view (FIG. 6D), of a drop ceiling system (Tile C) installed in a prior art standard drop ceiling hanger in accordance with the present disclosure.
Figure 6B:
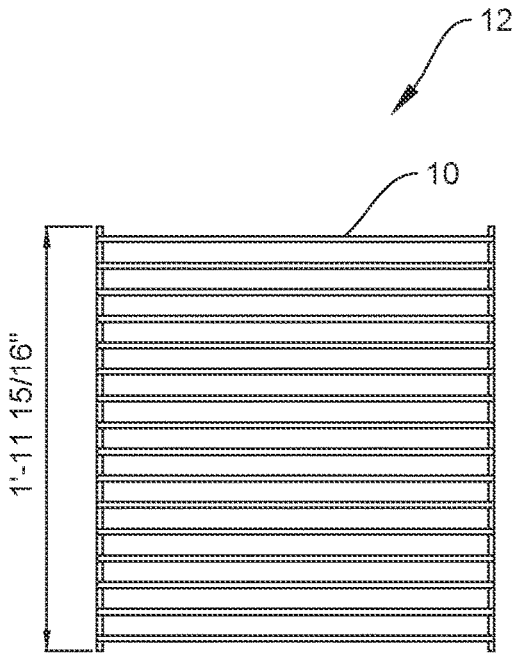
Figure 6C:
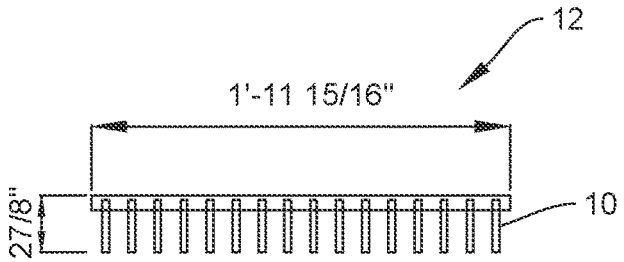
Figure 6D:
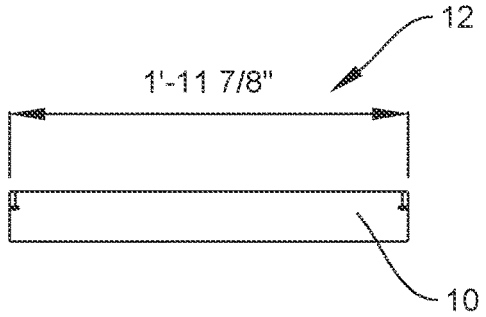

Likewise, next to tile B 12 is tile C 12, as shown in FIGS. 6A through 6D, and which include a perspective view (FIG. 6A), plan view (FIG. 6B), side elevation view (FIG. 6C), and front elevation view (FIG. 6D). The dynamic acoustic drop ceiling tile C 12, as previously shown in FIG. 3A, is assembled and located next to tile B 12 in the prior art standard drop ceiling hanger 30 in accordance with the present disclosure.

Figure 7A:
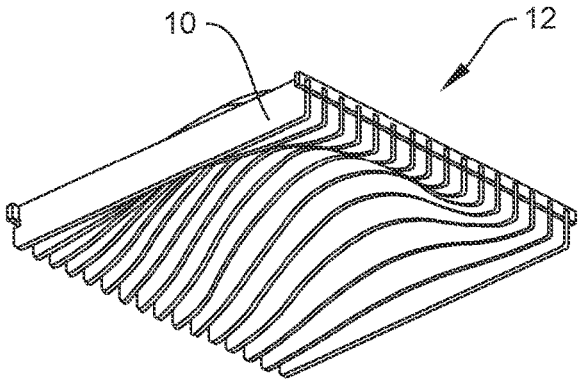
FIGS. 7A through 7D are perspective view (FIG. 7A), plan view (FIG. 7B), side elevation view (FIG. 7C), and front elevation view (FIG. 7D), of a drop ceiling system (Tile D) installed in a prior art standard drop ceiling hanger in accordance with the present disclosure.
Figure 7B:
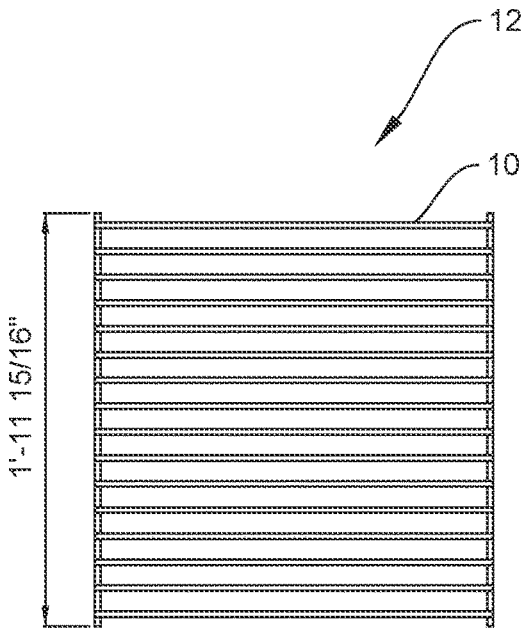
Figure 7C:
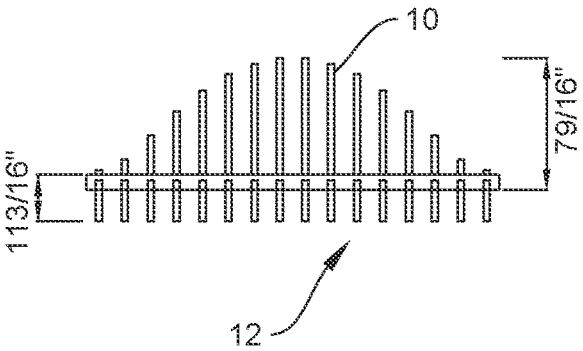
Figure 7D:
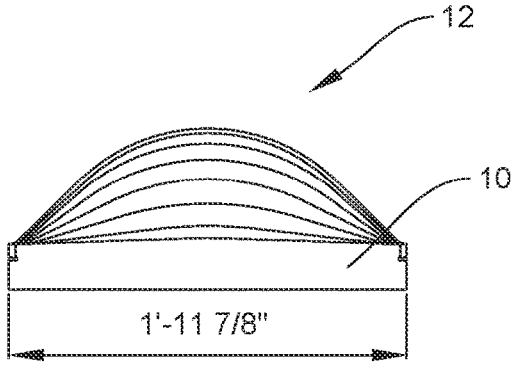

Finally, next to tile C 12 is tile D 12, as shown in FIGS. 7A through 7D, and which include a perspective view (FIG. 7A), plan view (FIG. 7B), side elevation view (FIG. 7C), and front elevation view (FIG. 7D). The dynamic acoustic drop ceiling tile D 12, as previously shown in FIG. 3A, is assembled and located next to tile C 12 in the prior art standard drop ceiling hanger 30 in accordance with the present disclosure. Together, these four tile sections 12 create an undulating design as seen from the floor of the room.

As also shown in FIG. 3C, the tile sections 12 A, B, C and D can be repeated continuously throughout the room to continue the undulating design effect and to create the drop ceiling system 100.

Figure 8A:
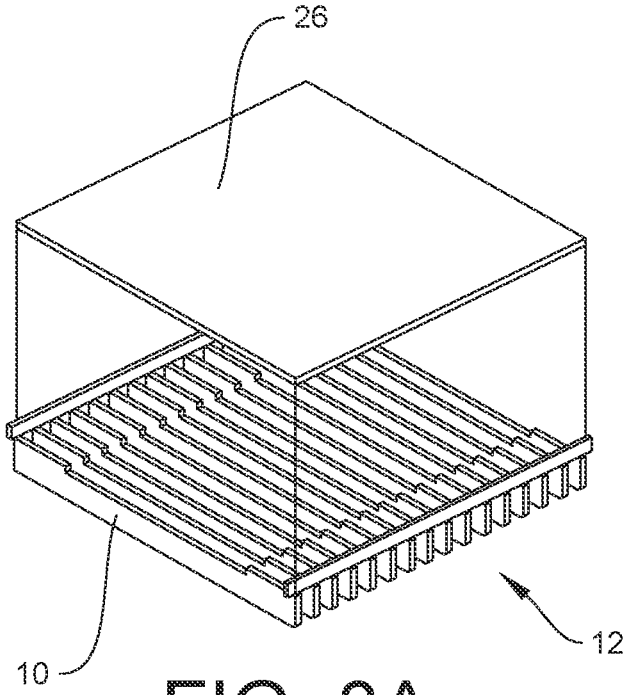
FIGS. 8A and 8B are perspective views of an acoustic drop ceiling product in accordance with the present disclosure.
Figure 8B:
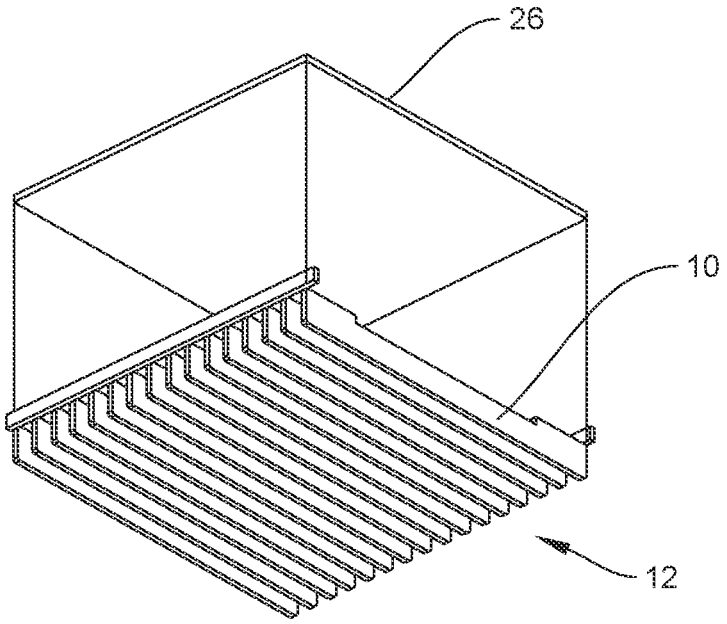

FIGS. 8A and 8B show top and bottom perspective views, respectively, of an embodiment to the present disclosure that includes a backer panel or tile cap 26. The backer panel 26 can also be made of felt, similar to the drop ceiling product 10 disclosed herein. Each of the drop ceiling product 10 can be installed into the backer panel 26, as described herein, thereby intersecting with the drop ceiling product 10 of the tile sections 12 to provide additional acoustic dampening and further blocking the view of the ceiling. Of course, the backer panel 26 may be made of other materials.

Figure 9:
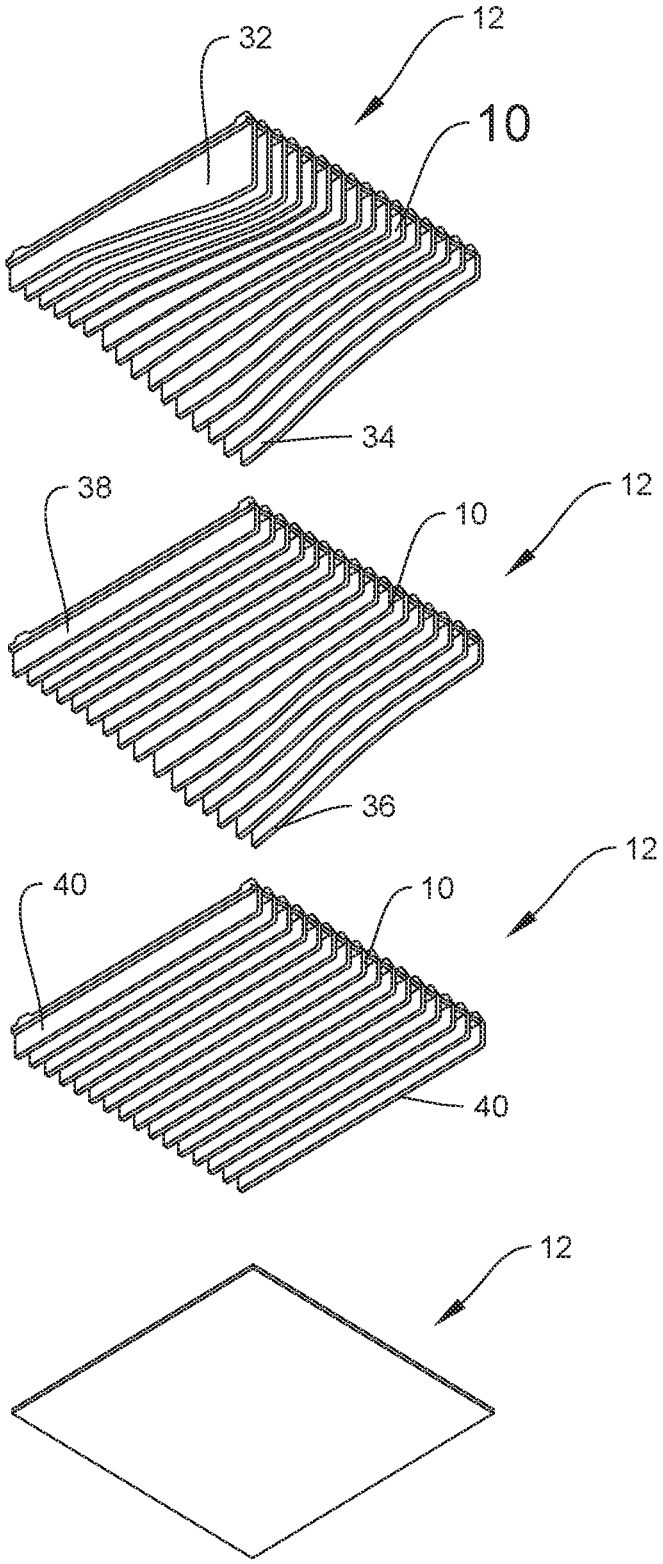
FIG. 9 shows perspective views of different tile section types in accordance with the present disclosure.

In an alternative embodiment, there can be four types of tile section 12 A, B, C and X to make up a drop ceiling system 100. FIG. 9 shows these four tile section 12 types, with type A 12 using various drop ceiling product 10 to have a tile section that shows undulating on one side 32, to undulating on the other side 34. Tile section B 12 uses various drop ceiling product 10 to create a tile section 12 that undulates on one side 36 and is flat or straight on the other side 38. Tile section C 12 uses the straight drop ceiling product 10 to create a tile section 12 that is straight or flat on both sides 40. Tile section X 12 does not use any drop ceiling product 10. These last tile sections 12 are used on boundary conditions and have no pattern. Using these tile sections 12 A, B, C and X, a drop ceiling system 100 can be generated by placing similar sides together.

Figure 10:
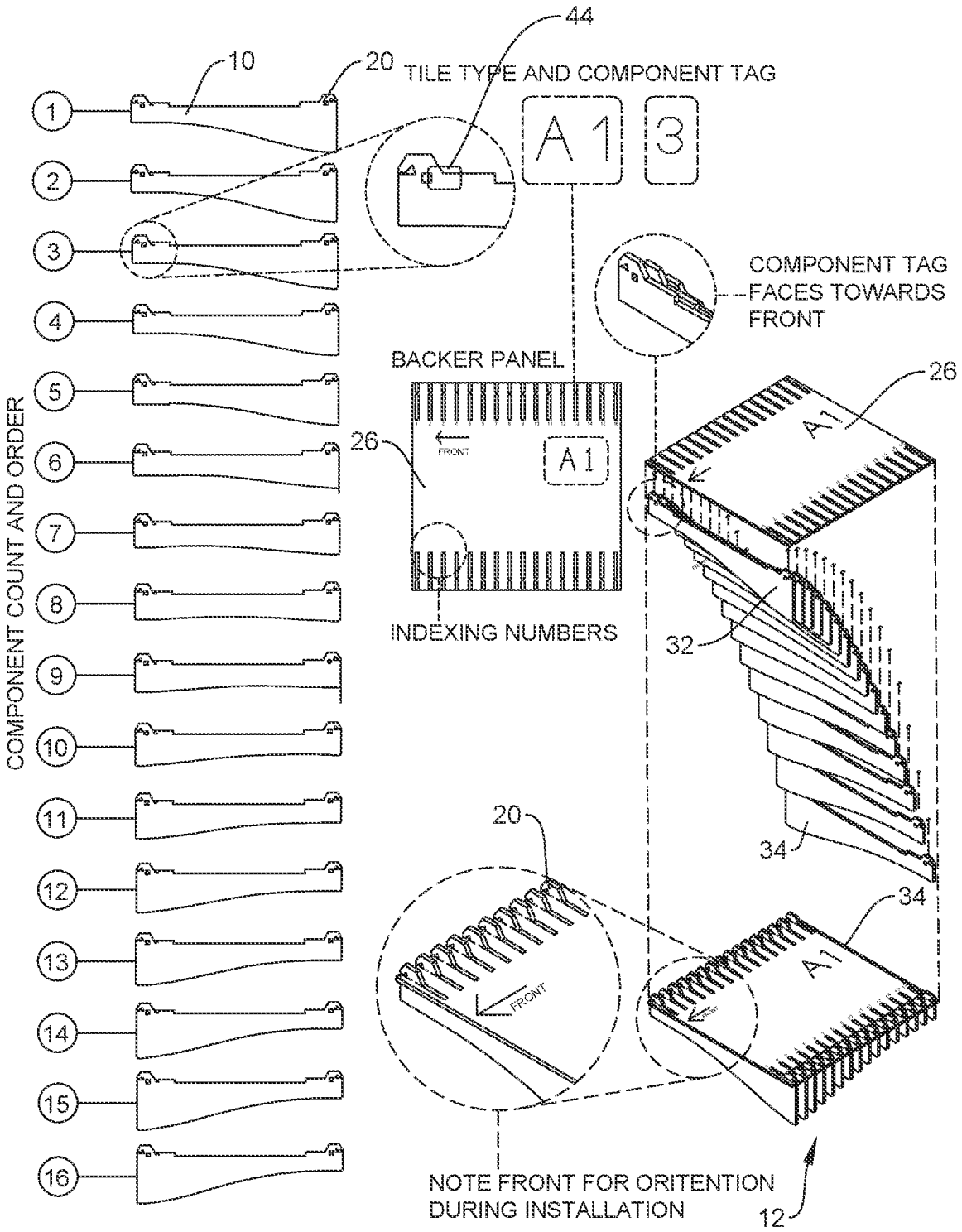
FIG. 10 shows a tile section assembly in accordance with the present disclosure.
Figure 11:
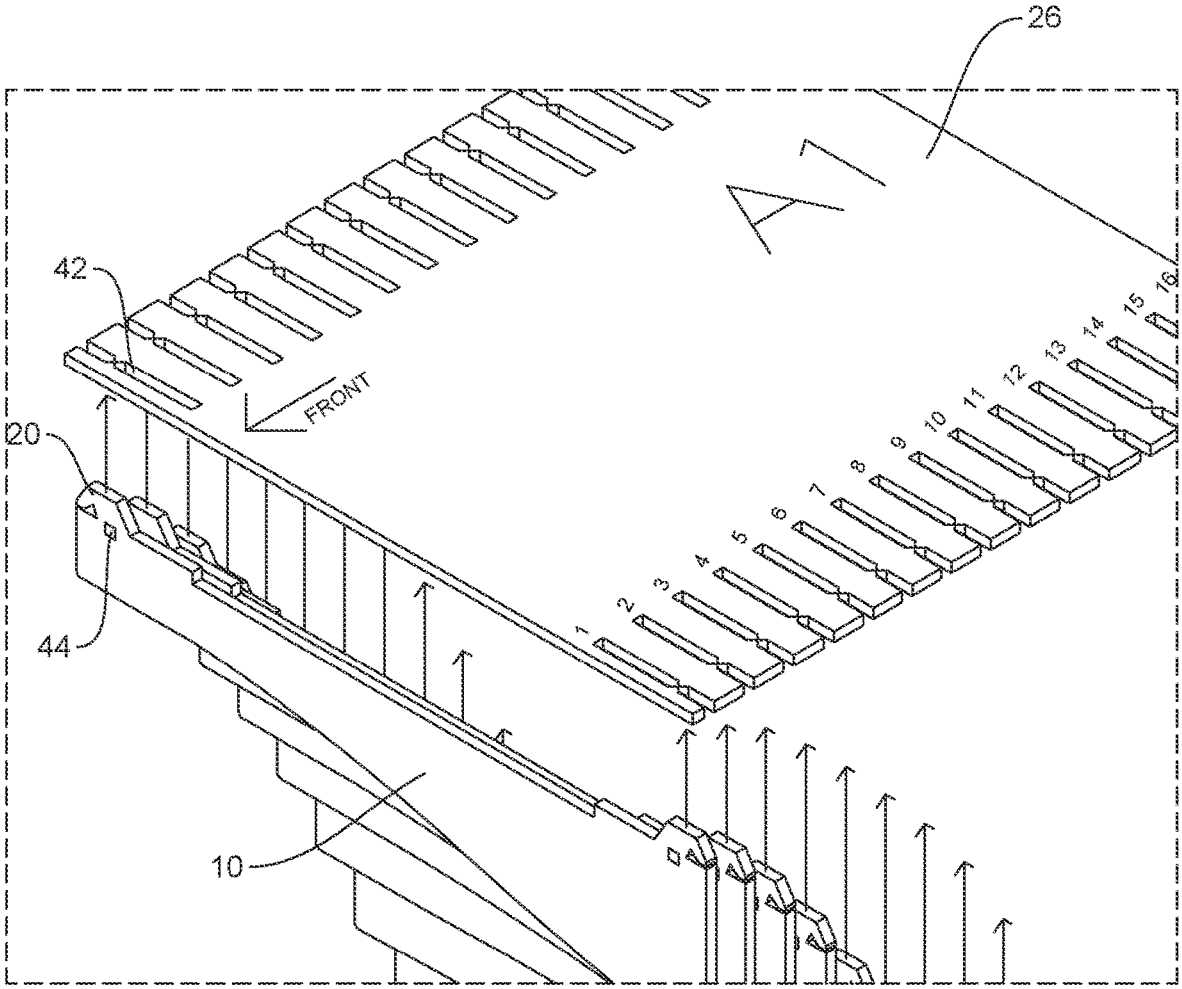
FIG. 11 shows a tile section assembly in accordance with the present disclosure.

FIG. 10 shows the assembly of a tile section 12 using a backer panel 26 and various drop ceiling product 10. The example shown here is similar to tile section A 12 in which the drop ceiling product 10 goes from undulating on one side 32 to undulating on the other side 34. The two installation slots 20 of each of the 16 drop ceiling product 10 are pushed through the indents 42 of the backer panel 26 until the drop ceiling product 10 is locked into place and rests on the backer panel 26, as shown enlarged in FIG. 11.

Each drop ceiling product 10 can have a component tag 44, which details which tile section 12 the product 10 is to be installed and where on that tile section 12. For example, the third drop ceiling product on the tile section A1 may have a component tag 44 that reads A1-3.

Figure 12:
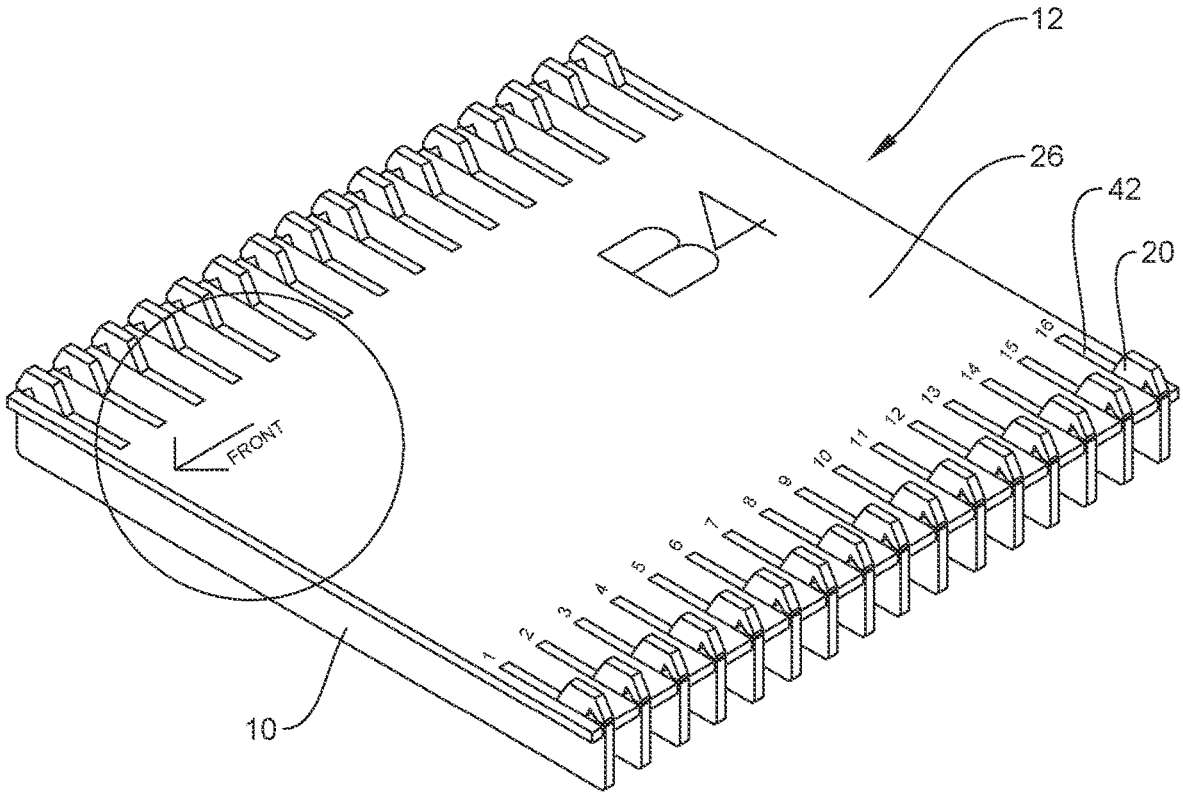
FIG. 12 shows a tile section assembly in accordance with the present disclosure.

Once all of the drop ceiling product 10 have been inserted into the backer panel 26, such that the installation slots 20 have pushed through the backer panel indents 42, the tile section 12 will look like FIG. 12 from above. The tile section 12 is now ready to be installed onto the t-grid or drop ceiling hanger system 28.

Figure 13A:
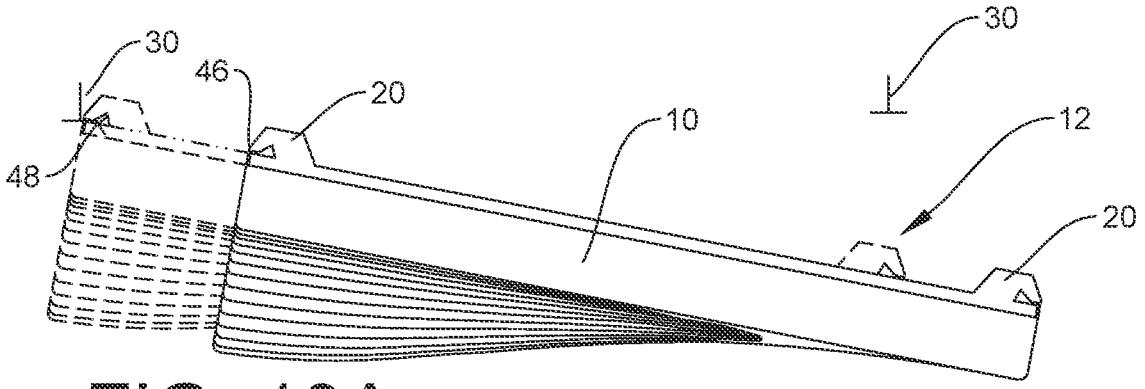
FIGS. 13A through 13D shows a tile section installation in accordance with the present disclosure.
Figure 13B:
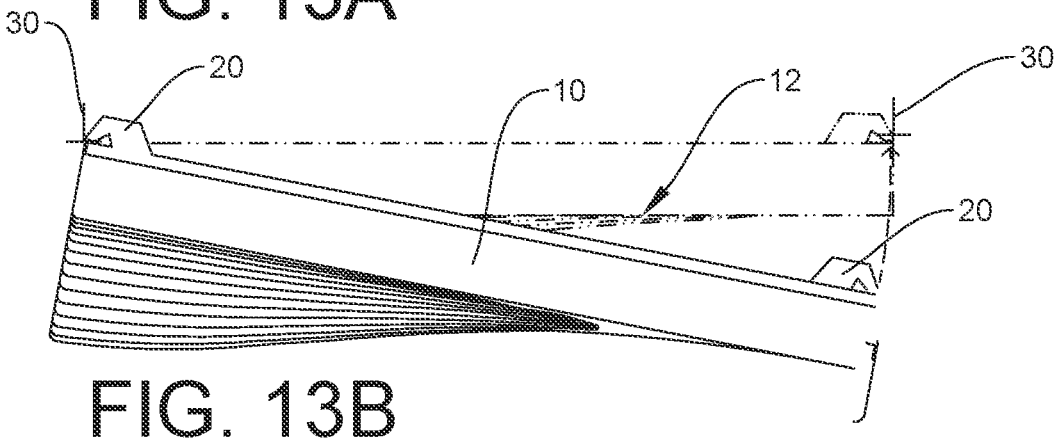
Figure 13C:
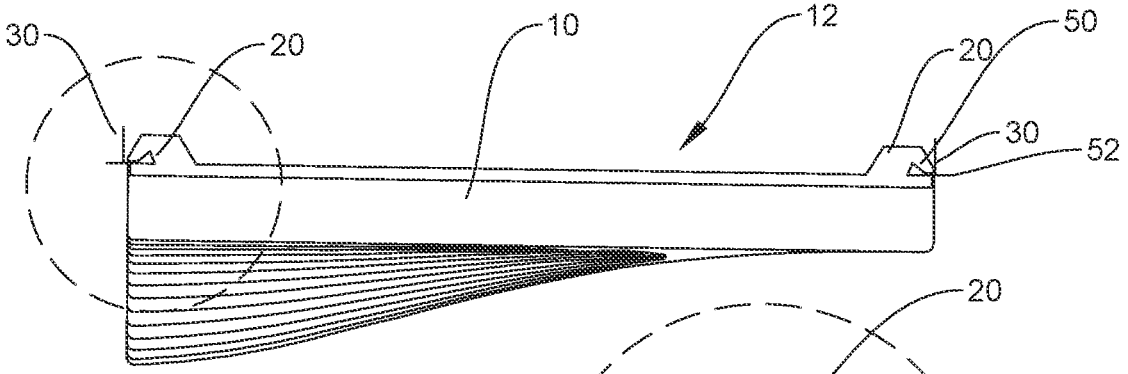
Figure 13D:
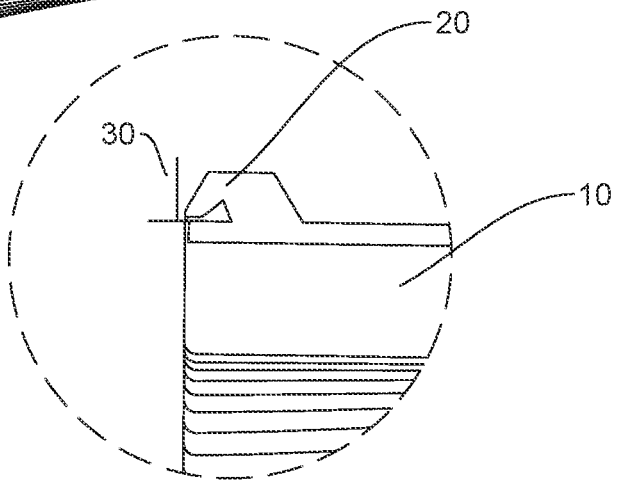

FIGS. 13A through 13C show the tile section 12 installation onto the drop ceiling hanger FIG. 13A shows the tile section 12 placed at an angle so that one edge 46 of the product can slide onto the hanger 30 so that the installation slot 20 will travel over the edge 48 of the hanger 30 (see FIG. 13B). Next the tile section 12 is rotated and popped into place with the installation slot 20 at the opposite edge 50 flexing then snapping back to form over the opposite edge 52 of opposite hanger 30. Once completed, each side and each drop ceiling product 10 will look similar to FIG. 13D, which is an enlargement of FIG. 13C. By installing the tile section 12 in this manner, the outside section of the backer panel 26 can partially or totally obscure from view the bottom side of the hanger 30, for anyone standing on the floor looking up at the ceiling.

Figure 14:
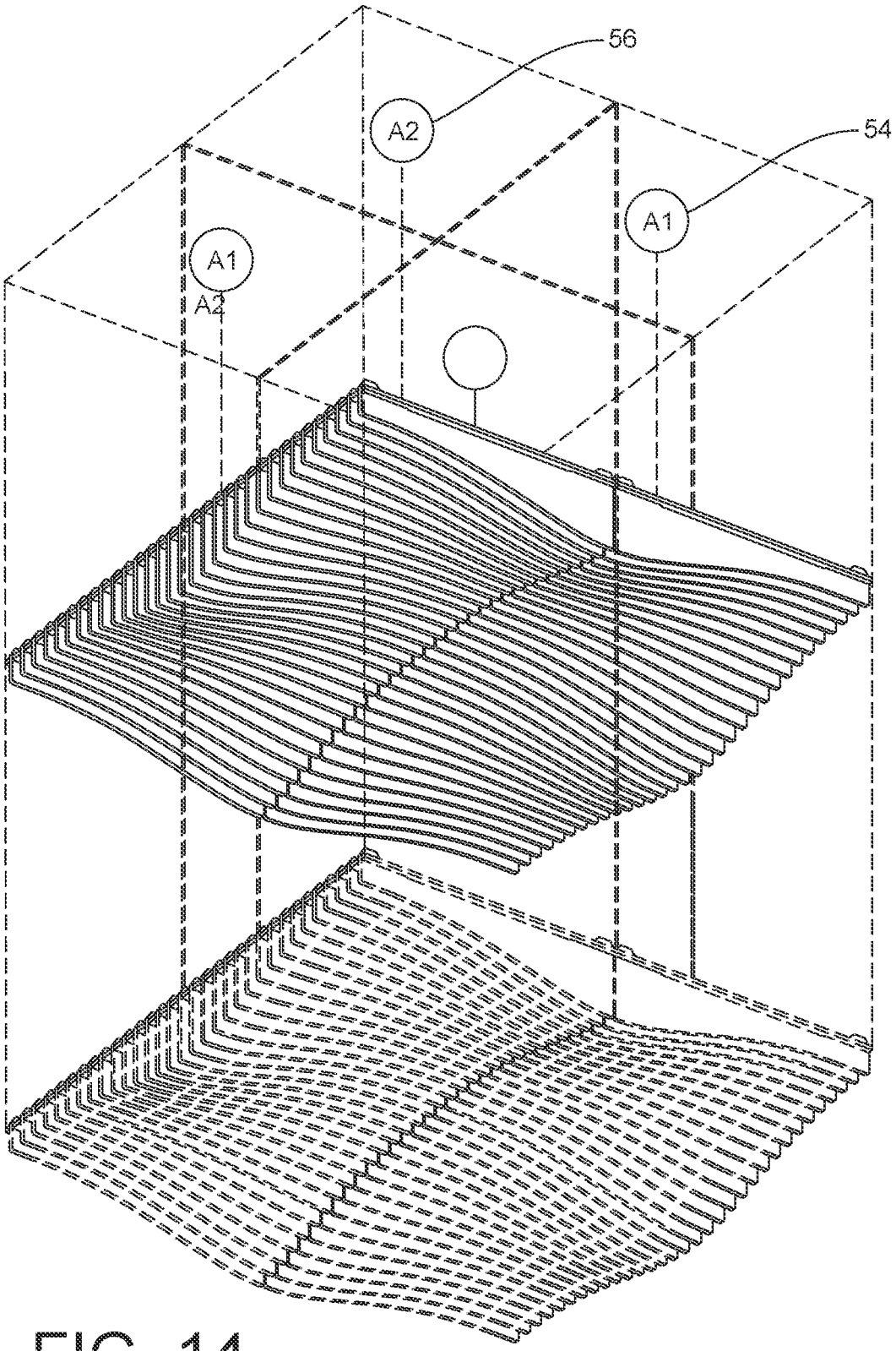
FIG. 14 shows a tile section sample grouping in accordance with the present disclosure.
Figure 15:
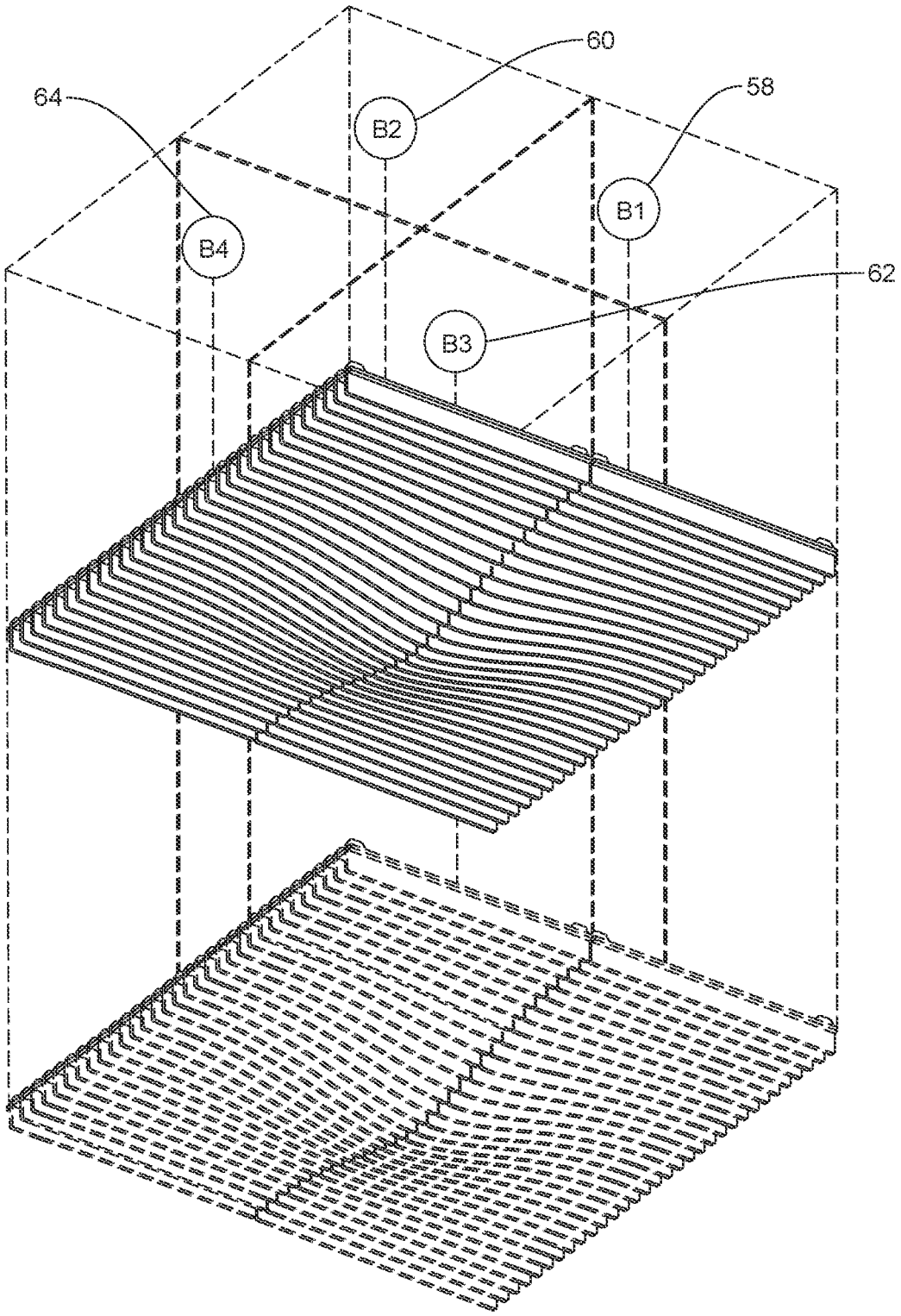
FIG. 15 shows a tile section sample grouping in accordance with the present disclosure.

FIGS. 14 and 15 show sample groupings for a drop ceiling system 100 using four tile sections 12, with tiles A1 54 and A2 56, each used twice (FIG. 14), and tiles B1 58, B2 60, B3 62 and B4 64, each used once (FIG. 15). Clearly, numerous tile sections 12 can be generated and therefore numerous designs can be created using a small number of differently shaped products 10.

As described herein, the material used in the preferred embodiment is polyester felt and is 99% recycled. The ceiling baffles 10 in the preferred embodiment are 9 mm thick, with a standard size of 24 inches by 24 inches, and a maximum size of 24 inches by 48 inches, for 2' by 2' and 2' by 4' drop ceilings, respectively. The edge options are exposed felt, and maintenance includes occasional vacuuming to remove particulate matter and air-borne debris or dust. Compressed air can be used to dust off the material in difficult to reach areas and for large assemblies.

The felt comes in numerous colors, including white, cream, light grey, light brown, brown, matte grey, charcoal, black, yellow, mango, orange, red, lavender, lime, green, light blue and dark blue. Of course, the ceiling baffles 10 can be manufactured in many other colors and the present disclosure is not limited to these specifications and colors, as these are merely the specifications and colors for the preferred embodiments and alternative embodiments.

Figures 16, 17:
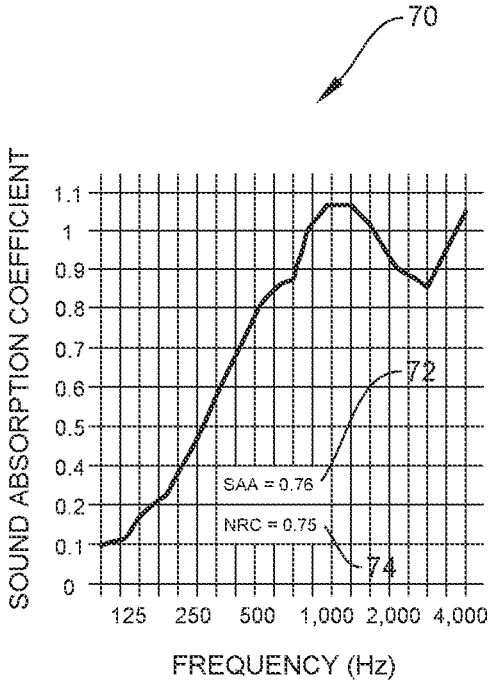
FIG. 16 is a chart of the acoustic testing in accordance with ASTM C 423 of the drop ceiling product in accordance with the present disclosure.
FIG. 17 is a graph of the acoustic testing in accordance with ASTM C 423 of the drop ceiling product in accordance with the present disclosure.

FIG. 16 shows a chart for the acoustic testing standard ASTM C423 for the drop ceiling product 10 in the preferred embodiment. The chart indicates testing on the preferred embodiment and provides the results of the sound absorption coefficient for the drop ceiling product 10 at various frequencies. The test arrangement used a +100 mm air layer filled with 50 mm rock wool board. As described herein, the noise reduction coefficient at 500 Hz 70 is 0.76 66, and at 1000 Hz 74 is 1.00 68. Further, the drop ceiling product 10 is fire rated as UL tested ASTM E-84: Class A.

FIG. 17 shows the graph 70 of the sound absorption coefficient against frequency for the same test, with the sound absorption average (SAA) 72 of 0.76, and the noise reduction coefficient (NRC) 74 of 0.75.

Reference throughout the specification to "various embodiments," "some embodiments," "one embodiment," or "an embodiment", or the like, means that a particular feature, structure, or characteristic described in connection with the embodiment is included in at least one embodiment. Thus, appearances of the phrases "in various embodiments," "in some embodiments," "in one embodiment," or "in an embodiment", or the like, in places throughout the specification are not necessarily all referring to the same embodiment.

Further, the particular features, structures, or characteristics may be combined in any suitable manner in one or more embodiments. Thus, the particular features, structures, or characteristics illustrated or described in connection with one embodiment may be combined, in whole or in part, with the features structures, or characteristics of one or more other embodiments without limitation given that such combination is not illogical or non-functional. Although numerous embodiments of this invention have been described above with a certain degree of particularity, those skilled in the art could make numerous alterations to the disclosed embodiments without departing from the spirit or scope of this disclosure.

All directional references (e.g., plus, minus, upper, lower, upward, downward, left, right, leftward, rightward, top, bottom, above, below, vertical, horizontal, clockwise, and counterclockwise) are only used for identification purposes to aid the reader's understanding of the present disclosure, and do not create limitations, particularly as to the position, orientation, or use of the any aspect of the disclosure.

As used herein, the phrased "configured to," "configured for," and similar phrases indicate that the subject device, apparatus, or system is designed and/or constructed (e.g., through appropriate hardware, software, and/or components) to fulfill one or more specific object purposes, not that the subject device, apparatus, or system is merely capable of performing the object purpose. Joinder references (e.g., attached, coupled, connected, and the like) are to be construed broadly and may include intermediate members between a connection of elements and relative movement between elements. As such, joinder references do not necessarily infer that two elements are directly connected and in fixed relation to each other. It is intended that all matter contained in the above description or shown in the accompanying drawings shall be interpreted as illustrative only and not limiting. Changes in detail or structure may be made without departing from the spirit of the invention as defined in the appended claims.

Any patent, publication, or other disclosure material, in whole or in part, that is said to be incorporated by reference herein is incorporated herein only to the extent that the incorporated materials does not conflict with existing definitions, statements, or other disclosure material set forth in this disclosure. As such, and to the extent necessary, the disclosure as explicitly set forth herein supersedes any conflicting material incorporated herein by reference. Any material, or portion thereof, that is said to be incorporated by reference herein, but which conflicts with existing definitions, statements, or other disclosure material set forth herein will only be incorporated to the extent that no conflict arises between that incorporated material and the existing disclosure material.

What is claimed is:

1. A ceiling system comprising:

a backer panel comprising:

a top surface;

a bottom surface opposite the top surface; and a plurality of openings extending from the top surface to the bottom surface;

a plurality of ceiling components, each of the plurality of ceiling components comprising:

a main body; and a pair of tabs protruding upward from the main body and configured to engage first and second ceiling hangers of a ceiling hanger system;

the plurality of ceiling components assembled to the backer panel to form a ceiling tile in which: (1) the main bodies of the plurality of ceiling components are below the backer panel; and (2) the pairs of tabs of the plurality of ceiling components pass through the plurality of openings and protrude from the top surface of the backer panel to allow mounting of the ceiling tile to the ceiling hanger system via the pairs of tabs engaging the first and second ceiling hangers.

2. The ceiling system according to claim 1 wherein the backer panel and each of the plurality of ceiling components are formed of acoustic absorbing material.

3. The ceiling system according to claim 2 wherein the backer panel and each of the plurality of ceiling components are formed of felt.

4. The ceiling system according to claim 1 wherein the ceiling tile comprises the plurality of ceiling components assembled to the backer panel so that the main bodies of the plurality of ceiling components extend substantially parallel to one another.

5. The ceiling system according to claim 1 further comprising:

for each the plurality of ceiling components, the main body comprising a panel; and the ceiling tile comprising the plurality of ceiling components assembled to the backer panel so that the panels of the main bodies of the plurality of ceiling components extend orthogonal from the bottom surface of the backer panel.

6. The ceiling system according to claim 5 wherein for each the plurality of ceiling components, the panel of the main body and the pair of tabs are a monolithic component.

7. The ceiling system according to claim 1 further comprising:

for each of the plurality of ceiling components, the main body comprising a first side and a second side opposite the first side, each of the first and second sides extending from a bottom side to a top side of the main body; and for each of the plurality of ceiling components, the pair of tabs comprising a first tab and a second tab, the first tab comprising a first hook portion, and the second tab comprising a second hook portion, the first and second hook portions configured to engage the first and second ceiling hangers respectively.

8. The ceiling system according to claim 7 further comprising:

for each of the plurality of ceiling components, the first tab comprising a first base portion extending upward from the main body and a first arm portion extending from the first base portion in a first direction toward the first side of the main body to form a first open recess below the first arm portion, and the second tab comprising a second base portion extending upward from the main body and a second arm portion extending from the second base portion in a second direction toward the second side of the main body to form a second open recess below the second arm portion, the second direction being opposite the first direction.

9. The ceiling system according to claim 8 further comprising:

the ceiling hanger system, the first and second ceiling hangers extending parallel to one another, each of the first and second ceiling hangers comprising a horizontal flange portion having an edge, the edges of horizontal flange potions of the first and second ceiling hangers separated from one another by a first horizontal distance;

for each of the plurality of ceiling components, the first arm portion terminating in a first distal end and the second arm portion terminating in a second distal end, the first and second distal ends separated from one another by a second horizontal distance that is greater than the first horizontal distance;

the ceiling tile mounted to the ceiling hanger system due to the horizontal flange portions of the first and second ceiling hangers nesting in the first open recess and the second open recess respectively.

10. The ceiling system according to claim 1 wherein for each of the plurality of ceiling components, each of the first and second tabs comprises a tapered upper edge that slopes downward outwardly.

11. The ceiling system according to claim 1 further comprising:

the openings of the backer panel comprising a plurality of first openings arranged in a first linear array and a plurality of second openings arranged in a second linear array, the first and second arrays located on opposite sides of a center line of the backer panel.

12. A ceiling system comprising:

a ceiling hanger system comprising a plurality of ceiling hangers arranged in a rectilinear grid defining a plurality of grid openings;

a plurality of ceiling tiles, each of the plurality of ceiling tiles comprising:

a backer panel formed of an acoustic absorbing material and comprising a top surface, a bottom surface opposite the top surface, and a plurality of openings extending from the top surface to the bottom surface;

a plurality of ceiling components formed of an acoustic absorbing material and assembled to backer panel, each of the plurality of ceiling components comprising a main body below the bottom surface of the backer panel and at least one tab extending upward from the main body that passes through one of the plurality of openings of the backer panel and protrudes from the top surface of the backer panel; and the plurality of ceiling tiles mounted to the ceiling hanger system via the tabs of the plurality of ceiling tiles engaging the plurality of ceiling hangers.

13. The ceiling system according to claim 12 wherein each of the plurality of ceiling tiles is aligned with one of the grid openings; and wherein the backer panel of each of the plurality of ceiling tiles encloses the grid opening with which the ceiling tile is aligned.

14. The ceiling system according to claim 12 further comprising:

the rectilinear grid lying within a first plane; and for each of the plurality of ceiling tiles, the top surface of the backer panel is parallel to the first plane.

15. The ceiling system according to claim 12 further comprising:

for each of the plurality of ceiling tiles, the main bodies of the plurality of ceiling components arranged parallel to one another along the bottom surface of the backer panel; and for each of the plurality of ceiling tiles, the tabs of the plurality of ceiling components comprising hook portions protruding from the top surface of the backer panel, the hook portions engaging horizontal flange potions of the plurality of ceiling hangers.

16. The ceiling system according to claim 15 further comprising:

for each of the plurality of ceiling tiles, each of the hook portions of the plurality of ceiling components comprising a base portion extending upward from the main body and an arm portion extending from the base portion in an outward direction to form an open recess below the arm portion and above the top surface of the backer panel; and the horizontal flange potions of the plurality of ceiling hangers nesting within the open recesses to mount the plurality of ceiling tiles to the ceiling hanger system.

17. The ceiling system according to claim 12 wherein the tabs of the plurality of ceiling components are configured to deform or move around the plurality of ceiling hangers during mounting of the plurality of ceiling tiles to the ceiling hanger system.

18. The ceiling system according to claim 17 further comprising:

for each of the plurality of ceiling components, the main body comprising a first side and a second side opposite the first side, each of the first and second sides extending from a bottom side to a top side of the main body;

each of the plurality of ceiling components comprising first and second ones of the at least one tab, the first tab comprising a first base portion extending upward from the main body and a first arm portion extending from the first base portion in a first direction toward the first side of the main body to form a first open recess below the first arm portion, and the second tab comprising a second base portion extending upward from the main body and a second arm portion extending from the second base portion in a second direction toward the second side of the main body to form a second open recess below the second arm portion, the second direction being opposite the first direction; and wherein for each of the plurality of ceiling components, each of the first and second tabs comprises a tapered upper edge that slopes downward outwardly.

19. A ceiling system comprising:

a backer panel formed of a felt material and comprising:

a top surface;

a bottom surface opposite the top surface; and a plurality of openings extending from the top surface to the bottom surface;

a plurality of linear ceiling components formed of a felt material, the plurality of linear ceiling components mounted to the backer panel adjacent the bottom surface of the backer panel in a parallel arrangement to form a ceiling tile, each of the plurality of ceiling components comprising a plurality of tabs that extend through the openings of the backer panel and protrude from top surface of the backer panel, each of the tabs comprising an outwardly-facing recess that is configured to receive and engage an edge of a ceiling hanger of a ceiling hanger system to mount the ceiling tile to the ceiling hanger system.

20. The ceiling system according to claim 19 further comprising:

each of the plurality of ceiling components comprising a main body having a first side and a second side opposite the first side, each of the first and second sides extending from a bottom side to a top side of the main body; and for each of the plurality of ceiling components, the plurality of tabs comprising a first tab and a second tab, the first tab comprising a first base portion extending upward from the main body and a first arm portion extending from the first base portion in a first direction toward the first side of the main body to form a first open recess below the first arm portion, and the second tab comprising a second base portion extending upward from the main body and a second arm portion extending from the second base portion in a second direction toward the second side of the main body to form a second open recess below the second arm portion, the second direction being opposite the first direction; and wherein for each of the plurality of ceiling components, each of the first and second tabs comprises a tapered upper edge that slopes downward outwardly.

* * * * *